US010323641B2

(12) United States Patent
Tanner et al.

(10) Patent No.: US 10,323,641 B2
(45) Date of Patent: Jun. 18, 2019

(54) BELOW MOTOR EQUALIZER OF ELECTRICAL SUBMERSIBLE PUMP AND METHOD FOR FILLING

(71) Applicant: Baker Hughes Incorporated, Houston, TX (US)

(72) Inventors: David Tanner, Broken Arrow, OK (US); Aron M. Meyer, Pryor, OK (US); Arturo Luis Poretti, Claramore, OK (US); Ryan P. Semple, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 872 days.

(21) Appl. No.: 14/683,557

(22) Filed: Apr. 10, 2015

(65) Prior Publication Data

US 2015/0337843 A1 Nov. 26, 2015

Related U.S. Application Data

(60) Provisional application No. 62/002,529, filed on May 23, 2014.

(51) Int. Cl.
*F04D 7/04* (2006.01)
*F04D 13/06* (2006.01)
(Continued)

(52) U.S. Cl.
CPC ..... *F04D 7/04* (2013.01); *F04B 47/024* (2013.01); *F04D 13/02* (2013.01); *F04D 13/062* (2013.01);
(Continued)

(58) Field of Classification Search
CPC .... E21B 34/12–34/16; E21B 2034/002; E21B 2034/005; E21B 2034/007;
(Continued)

(56) References Cited

U.S. PATENT DOCUMENTS 2,674,194 A * 4/1954 Arutunoff ..... F04D 13/0653 277/549
2,739,252 A * 3/1956 Patterson ..... F04D 13/10 310/87

(Continued)

*Primary Examiner* — Bryan M Lettman
*Assistant Examiner* — Charles W Nichols
(74) *Attorney, Agent, or Firm* — Bracewell LLP; James E. Bradley

(57) ABSTRACT

An electrical submersible pump assembly has a pressure equalizer coupled to a lower end of a motor. The equalizer has a motor lubricant passage through which lubricant in the motor communicates with motor lubricant in the equalizing element. A valve element in the motor lubricant passage has a closed upper position and an open lower position. The valve element has a drive member on an upper end that mates with a shaft drive member on a lower end of the motor shaft while the valve element is in the upper position and disengages from the shaft drive member while the valve element is in the lower position. A locking feature between the valve element and the motor lubricant passage retains the valve element in the upper position and is releasable in response to rotation of the motor shaft in a selected direction.

13 Claims, 4 Drawing Sheets

(51) Int. Cl.

| | |
|---|---|
| ***F04B 47/02*** | (2006.01) |
| ***F04D 13/02*** | (2006.01) |
| ***F04D 13/08*** | (2006.01) |
| ***F04D 15/00*** | (2006.01) |
| ***F04D 13/10*** | (2006.01) |
| ***F04D 29/06*** | (2006.01) |

(52) U.S. Cl.
CPC ..... *F04D 13/08* (2013.01); *F04D 13/10* (2013.01); *F04D 15/0005* (2013.01); *F04D 29/061* (2013.01)

(58) Field of Classification Search
CPC ..... E21B 43/128; F04D 7/04; F04D 13/08; F04D 13/086; F04D 13/10; F04D 15/0005; F04D 15/0022; F04D 29/061; F04D 13/02; F04D 13/062; F04B 11/00; F04B 11/0008; F04B 47/024; H02K 5/12; H02K 5/1285; H02K 5/132; H02K 5/136
USPC ..... 166/330, 373, 386; 251/216–219, 267, 251/313; 310/87; 417/414
See application file for complete search history.

(56) References Cited

U.S. PATENT DOCUMENTS

| | | | | |
|---|---|---|---|---|
| 4,313,497 | A * | 2/1982 | Graham | E21B 23/01 166/124 |
| 4,421,166 | A * | 12/1983 | Cain | E21B 27/02 166/162 |
| 4,583,923 | A * | 4/1986 | James | F04B 47/06 310/87 |
| 6,688,860 | B2 * | 2/2004 | Du | E21B 43/128 310/87 |
| 7,708,534 | B2 * | 5/2010 | Parmeter | E21B 43/128 166/105 |
| 8,419,390 | B2 | 4/2013 | Merrill et al. | |
| 8,651,837 | B2 | 2/2014 | Tetzlaff | |

* cited by examiner

BELOW MOTOR EQUALIZER OF ELECTRICAL SUBMERSIBLE PUMP AND METHOD FOR FILLING

CROSS REFERENCE TO RELATED APPLICATION

This application claims priority to provisional application Ser. No. 62/002,259, filed May 23, 2014.

FIELD OF THE DISCLOSURE

This disclosure relates in general to submersible well pump assemblies and in particular to a below motor pressure equalizer and method of filling the equalizer and motor with lubricant.

BACKGROUND

Many hydrocarbon wells are produced by electrical submersible well pump assemblies (ESP). A typical ESP includes a centrifugal pump having a large number of stages, each stage having an impeller and a diffuser. An electrical motor couples to the pump for rotating the impellers. A pressure equalizer or seal section connects to the motor to reduce a pressure differential between lubricant in the motor and the hydrostatic pressure of the well fluid. The pressure equalizer has a motor lubricant passage leading from a flexible barrier such as a bag or bellows into the interior of the motor. The motor lubricant passage is always open to communicate well fluid pressure applied in the pressure equalizer to the flexible barrier to the motor lubricant in the motor.

With most prior art ESP's, the pressure equalizer or seal section is located between the motor and the pump. In others, the pressure equalizer is mounted below the motor. During a prior art installation using a below motor pressure equalizer, the pressure equalizer may be initially filled with lubricant and suspended vertically from a rig at the well site. The motor is then lowered onto the equalizer and secured. Then motor lubricant may be pumped in from the lower end of the motor and upward through the motor. Alternately, the motor may be evacuated by a vacuum pump, then filled from the top.

The weight of the motor lubricant filled into the motor while the assembly is suspended above the well would act hydrostatically on the bellows of the pre-filled pressure equalizer, possibly causing the bellows to become fully extended. If fully extended before lowering into the well, and if the motor is completely full of lubricant, the bellows would not be able to further extend due to an increase in temperature, requiring some of the lubricant to be expelled through a check valve. The combined equalizer and motor would thus be over-filled with lubricant before the assembly is lowered into the well. The preferred position of the bellows prior to lowering the assembly into a well provides adequate expansion capacity of the bellows in cases of low pressure and high temperature while also maintaining adequate contraction capacity in cases of high pressure and low temperature.

Also, if multiple motors are in tandem, the assembly can be quite lengthy, more than 100 feet. The total length, including the pressure equalizer, could be greater than the distance from the blocks of the rig to the wellhead. If the lower end of the assembly is lowered into the wellhead in order to accommodate the length of the assembly during motor lubricant filling, the procedure becomes difficult if lubricant is pumped from the lower end, which would require access to the lower end of the assembly.

SUMMARY

An electrical submersible pump has a pump and a motor with a rotatable shaft extending along a longitudinal axis and operatively coupled to the pomp for driving the pump. A pressure equalizer is coupled to an end of the motor, the equalizer having a movable element for communicating well fluid pressure exterior of the pressure equalizer to motor lubricant in the motor. An adapter connects the equalizer to the motor, the adapter having a motor lubricant passage through which lubricant in the motor communicates with motor lubricant in the equalizing element. A valve located in the motor lubricant passage selectively opens and closes the motor lubricant passage.

Preferably, the valve is remotely actuable between open and closed positions. In the preferred embodiment, an end portion of the shaft is in engagement with, the valve while the valve is in a closed position. The valve is movable from the closed position to an open position in response to rotation of the shaft. A locking feature retains the valve in the closed position. In the preferred embodiment, a technician engages an upper end of the motor and manually rotates the shaft to release the locking feature.

In the embodiment shown, the valve is axially movable from the closed position to an open position out of engagement with the shaft in response to manual rotation of the shaft. A spring urges the valve toward the open position.

In the preferred embodiment, the locking feature comprises a set of internal threads in the motor lubricant passage that engage a set of external threads on the valve element to retain the valve element is in a closed position. A seal between the exterior of the valve element and the motor lubricant passage adjacent the internal and external threads seals the valve element in the motor lubricant passage while the valve element is in the closed position. A drive member on an end of the valve element engages a drive member on end of the shaft, the drive members having mating torque drive surfaces.

The drive members may comprise a socket on an end of the valve element that receives an end of the motor shaft, the socket and the end of the shaft having mating torque drive surfaces. Rotation of the motor shaft in a selected direction rotates the valve element and releases the locking feature, causing the valve element to move axially from the closed position to the open position and the socket to disengage from the end of the motor shaft.

The lubricant passage may have a bypass area of larger diameter joining a seal area. A spring support may be mounted in the lubricant passage at a point joining the bypass area. The spring support has a central bore and at least one flow-through passage laterally spaced from the central bore. The valve element seals to the seal area while the valve element is in a closed position. The valve element has a cylindrical exterior having a diameter smaller than a diameter of the bypass area, enabling lubricant to flow around the valve element and through the flow-through passage while the valve element is in an open position.

In the embodiment shown, a pin protrudes axially from the valve element through the central bore of the spring support. A spring surrounds the pin and is located within the central bore. The spring urges the valve element axially toward the open position.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
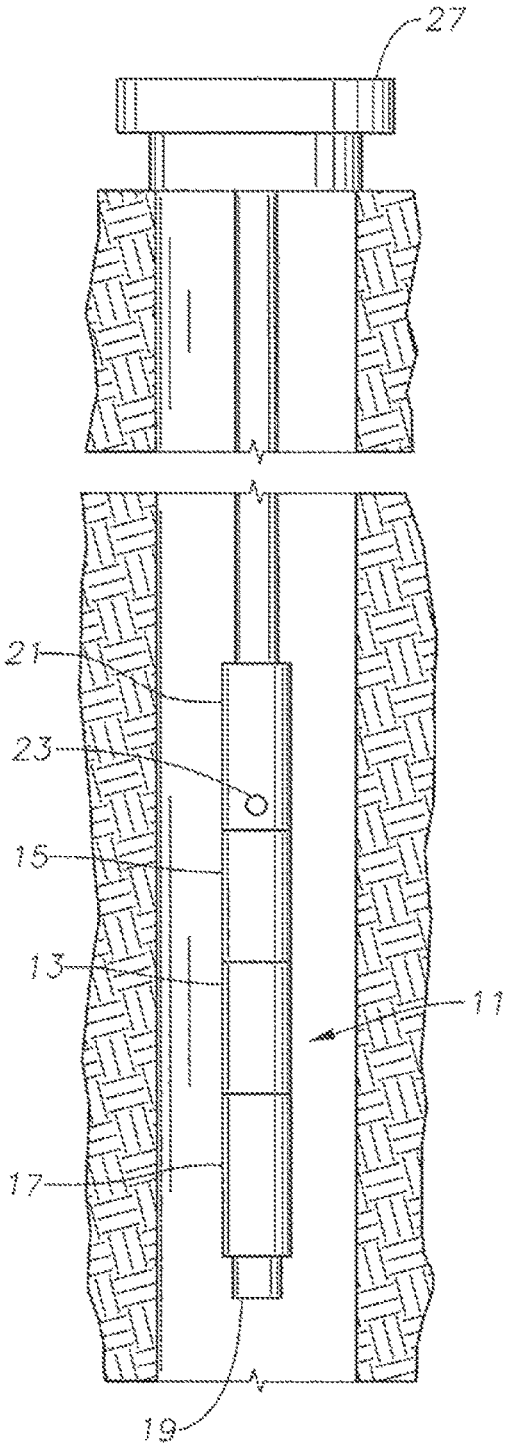
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical submersible pump (ESP) 11 typically includes an electrical motor 13. Motor 13 is normally a three-phase AC motor and may be connected in tandem to other motors. An upper seal section or thrust bearing unit 15 is illustrated at an upper end of motor 13. The terms "upper" and "lower" are used, only for convenience and not in a limiting manner. A pressure equalizer or lower seal section 17 is shown connected to a lower end of motor 13. Pressure equalizer 17 has features to reduce a pressure differential between a dielectric motor lubricant in motor 13 and the exterior well fluid hydrostatic pressure. An instrument module 19 to measure various motor and well fluid parameters optionally may be mounted to the lower end of pressure equalizer 17.

A rotary pomp 21 connects to the upper end of thrust bearing unit 15 in this example. Pump 21 could be a centrifugal pump with a large number of stages, each stage having an impeller and a diffuser. Alternately, pump 21 could be another type, such as a progressing cavity pump. Pump 21 has an intake 23 for admitting well fluid. A string of production tubing 25 secures to the upper end of pump 21 and supports ESP 11 in a well. Production tubing string 25 may be sections of tubing with threaded ends secured together, or it could be continuous coiled tubing. A wellhead assembly 27 at the upper end of the well supports production tubing string 25 and controls the flow of well fluid.

Figure 2:
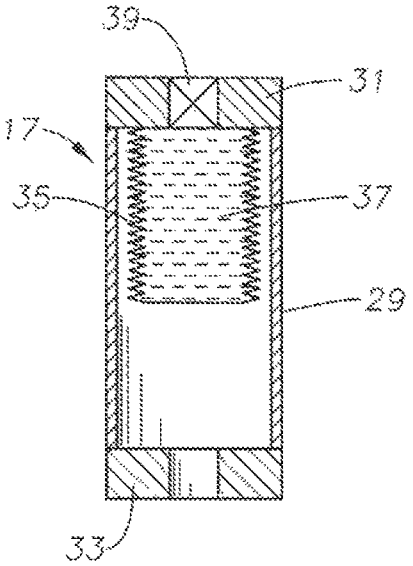
FIG. 2 is a schematic sectional view of the pressure equalizer of the pump assembly of FIG. 1, shown with the equalizer filled with motor lubricant.

Referring to the schematic representation of FIG. 2, pressure equalizer 17 has a tubular housing 29. An upper adapter 31 secures to the upper end of housing 29, such as by threads. A lower adapter 33 secures to the lower end of housing 37, and if an instrument module 19 (FIG. 1) is employed, it will secure to lower adapter 33. A flexible element, such as a bellows 35, mounts within housing 29 to the lower side of upper adapter 31 in this example. Bellows 35 may be metal and has an interior that is filled with motor lubricant 37 employed for lubricating the rotating components of motor 13 (FIG. 13). The exterior of bellows 35 may be immersed in well fluid that flows in from a port in housing 29, bellows 35 may be immersed in an intermediate liquid that is separated from well fluid by an additional flexible element (not shown). In either case, when ESP 11 (FIG. 1) is installed in a well, the hydrostatic pressure of well fluid on the exterior of ESP 11 is communicated to the interior of housing 29 in the chamber surrounding bellows 35. The interior of bellows 35 is sealed from the liquid in housing 29 surrounding bellows 35.

A plug or valve 39 in adapter 31, when closed, seals the motor lubricant 37 within bellows 35 and isolates the motor lubricant 37 within bellows 35 from motor lubricant in motor 13 (FIG. 1). As explained subsequently, valve 39 is remotely actuated from the closed to an open position, placing the motor lubricant 37 in bellows 35 in fluid communication with the motor lubricant in motor 13. Motor lubricant 37 in bellows 35 may be filled to a precise level at a service facility, a manufacturing facility, or at a well site prior to connecting pressure equalizer 17 to motor 13. As mentioned, motor 13 may be connected in tandem to other motors, and the motor lubricant 37 in each motor will be in fluid communication with that in the other motors. During operation of ESP 11, motor lubricant 37 in motor 13 will in fluid communication with motor lubricant 37 in pressure equalizer 17.

Figure 3:
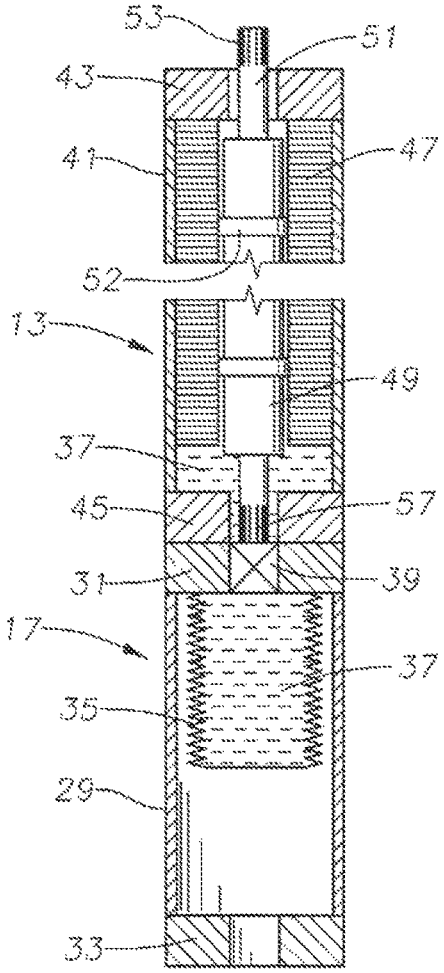
FIG. 3 is a schematic sectional view of the pressure equalizer of FIG. 2 mounted to a lower end of the motor of the pump assembly of FIG. 1, and prior to communicating lubricant in the motor with the lubricant in the equalizer.

Valve 39 is closed initially to prevent the hydrostatic weight of the lubricant in motor 13 from acting on the motor lubricant 37 in bellows 35 after motor 13 is coupled to the upper end of equalizer 17 while motor 13 is being filled. Pressure equalizer 17 can thus be precisely filled with bellows 35 in a desired position between fully extended and fully contracted. Referring to FIG. 3, motor 13, which may comprise a number of motors in tandem, is lowered onto and connected to pressure equalizer 17 after pressure equalizer 17 has been pre-filled precisely with motor lubricant 37 and valve 39 closed. In one method, motor lubricant 37 will not yet have been introduced into motor 13 when motor 13 is lowered onto and connected to pre-filled equalizer 17.

Motor 13 has a tabular housing 41 with an upper adapter 43 at the upper end and a lower adapter 45 at the lower end. Upper adapter 31 of pressure equalizer 17 secures to lower adapter 45 of motor 13, such as by bolting. A stator 47 extends most of the length of housing 41. Stator 47 comprises thin metal discs or laminations with windings extending through holes in the laminations. A rotor 49 mounts within central bore of stator 47. Rotor 49 is also made up of laminations and has copper rods extending longitudinally through holes in the laminations. Rotor 49 mounts to a drive shaft 51 and is made up in rotor sections separated by radial bearings 52. Shaft 51 has an upper splined end 53 and a lower splined end 57. Upper splined end 53 is within upper adapter 43 and lower splined end 57 is within lower adapter 45. In this example, lower splined end 57 comprises a drive member that engages a mating drive member of valve 39 once equalizer 17 is connected to motor 13, but lower splined end 57 does not move valve 39 to the open position, yet.

In one method, the operator introduces motor lubricant 37 into motor 13 after motor 13 has been connected to equalizer 17 and valve 39 remains closed. The filling procedure may proceed by pumping motor lubricant 37 into a lower port (not shown) in lower adapter 45. The operator may employ a vacuum pump to evacuate air horn motor 13 prior to pumping lubricant 37. The lubricant 37 flows up the spaces in motor housing 41 between upper and lower adapters 43, 45 and between rotor 49 and stator 47. Motor lubricant 37 in motor 13 is initially not in fluid communication with motor lubricant 37 in bellows 35 because valve 39 is closed. If vertical space for the entire assembly is needed, pressure equalizer 17 could be lowered into wellhead 27 (FIG. 1) before the filling procedure for motor 13 begins.

Figure 4:
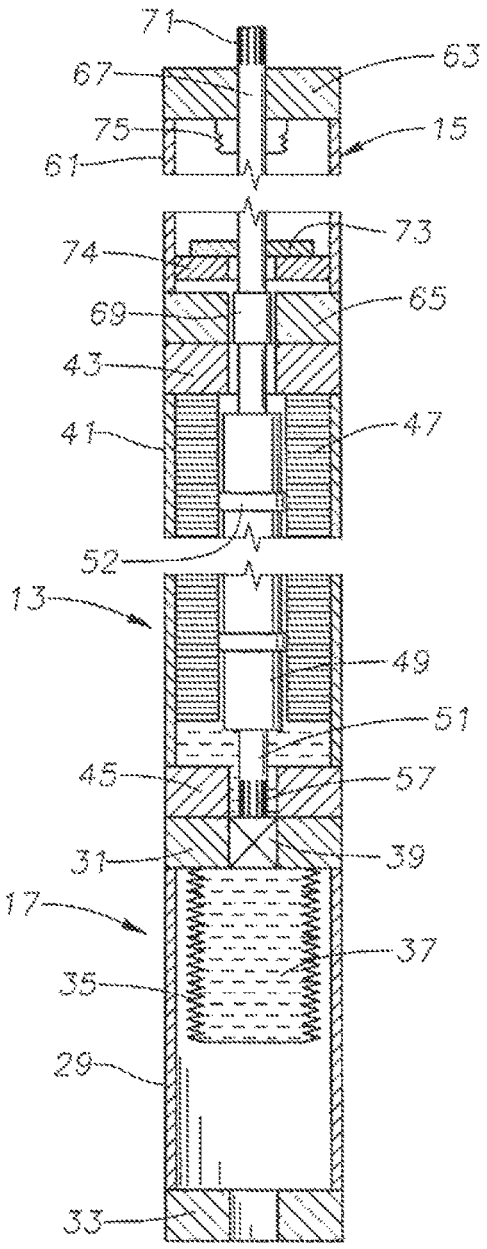
FIG. 4 is a schematic sectional view of the pressure equalizer and motor of FIGS. 2 and 3, with a thrust bearing unit of the pump assembly of FIG. 1 attached, and prior to communicating the lubricant in the motor with the lubricant in the equalizer.

FIG. 4 illustrates thrust bearing unit 15 attached to the upper end of motor 13, which in this example, occurs after motor 13 is filled with motor lubricant 37. In this example, prior to mounting thrust bearing unit 15 to motor 13, and after filing motor 13 with motor lubricant 37, the operator would lower the assembled equalizer 17 and motor 13 into wellhead 27 (FIG. 1) so as to facilitate connecting thrust bearing unit 15 to motor 13. Motor lubricant 37 is also contained in thrust bearing unit 15, and thrust bearing unit 15 could be filled with motor lubricant 37 after it has been connected to motor 13. If vertical space of the rig permits, thrust bearing unit 15 could be mounted to motor 13 before motor 13 is filled with lubricant.

Thrust bearing unit 15 has a housing 61 with an upper adapter 63 and a lower adapter 65 for connecting to pump 21 (FIG. 1) and motor 13 respectively. A thrust bearing unit shaft 67 extends through upper adapter 63 and lower adapter 65. A splined coupling 69 connects the lower end of thrust bearing unit shaft 67 to the splined upper end 53 of motor shaft 51; thus thrust bearing unit shaft 67 may be considered to be a part of motor shaft 51. Thrust bearing unit shaft 67 has an upper splined end 71 accessible from upper adapter 63. A thrust bearing runner 73 rotates with thrust bearing unit shaft 67 and rotatably engages a thrust bearing pad 74. A mechanical shaft seal 75 seals between thrust bearing shaft 67 and upper adapter 63, sealing well fluid from entering housing 61.

Figure 6:
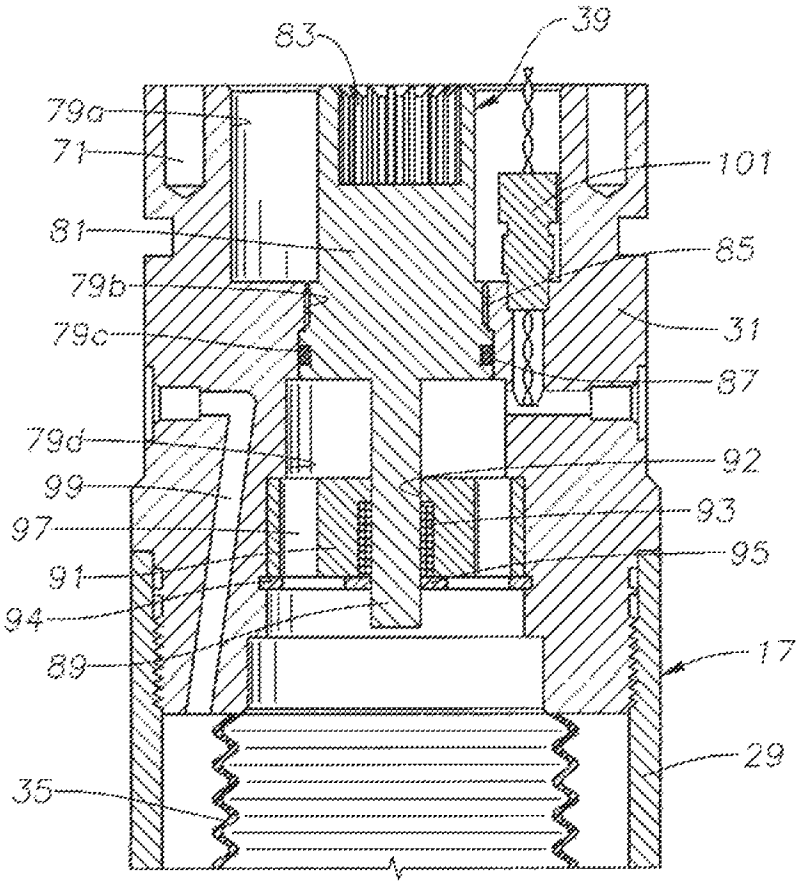
FIG. 6 is a sectional view of the equalizer of FIG. 5, taken along the line 6-6 of FIG. 5 and shown with the valve in a closed position.
Figure 5:
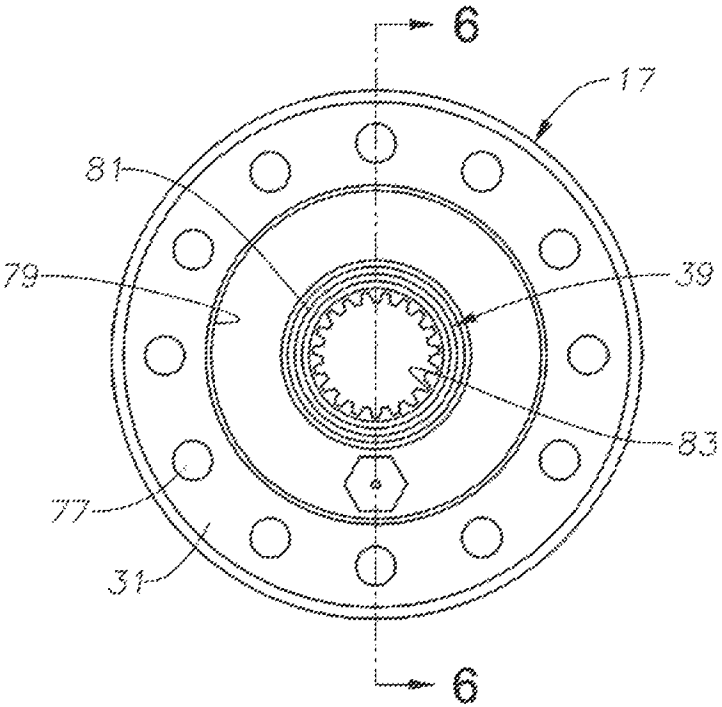
FIG. 5 is a transverse sectional and more detailed view of a portion of the equalizer of FIG. 5.
Figure 7:
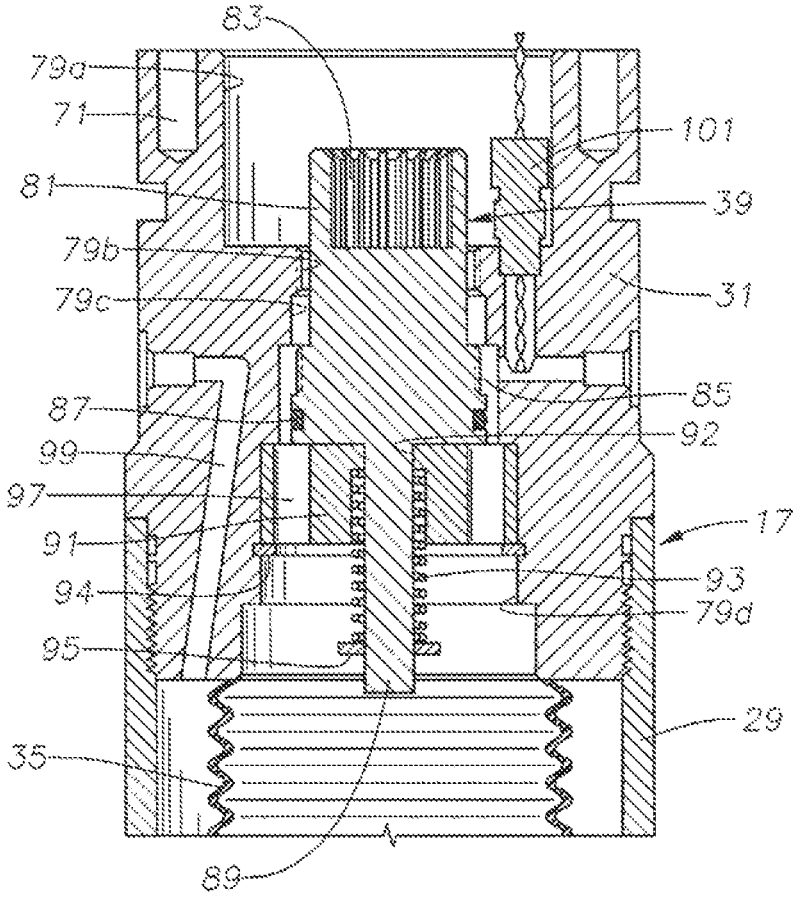
FIG. 7 is a sectional view of the equalizer of FIG. 5, taken along the line 6-6 of FIG. 5 and shown with the valve in an open position.

Referring to FIG. 5, equalizer upper adapter 31 has means, such as a bolt hole pattern 77 or a rotatable threaded collar (not shown), for securing equalizer 17 to motor 13 (FIG. 1). As shown in FIGS. 6 and 7, a motor lubricant passage having an axial bore 79 extends through upper adapter 63. Bore 79 has an upper enlarged portion 79*a* extending downward to a reduced diameter threaded portion 79*b*. A seal area or portion 79*c* of slightly greater diameter extends below threaded portion 79*b*. Bore 79 has lower portions 79*d* of several successively larger diameters extending below seal portion 79*c*.

Valve 39 has a valve element or body 81 located within bore upper portion 79*a*. Body 81 has an upward-facing splined receptacle or drive member 83 that is engaged by motor shaft lower splined end or drive member 57 (FIG. 3) when equalizer 17 is connected to motor 13. Valve body 81 has an externally threaded section 85 that engages bore threaded portion 79*c* while valve 39 is in the closed position of FIG. 6. Internal threaded section 79*b* and external threaded section 85 serve as a locking feature to releasably retain body 81 in the upper closed position. A seal 87 on valve body 81 seals to bore seal portion 79*c* while valve 39 is in the closed position. The portion of body 81 containing seal 87 is smaller in diameter than bore portion 79*d*, which serves as a bypass area to allow flow ground body 81 while body 81 is in the lower open position of FIG. 7.

Valve body 81 has a smaller diameter cylindrical portion or pin 89 extending downward. Pin 89 extends through a central aperture or bore 92 in a spring support 91. Spring support 91 is a cylindrical element secured in bore lower portion 79*c*, such as by a snap ring 94. A coil spring 93 secured in central aperture 92 has an upper end bearing against a downward facing shoulder and a lower end bearing against a retainer 95. Spring support 91 has flow-through passages 97 extending axially through and spaced around central aperture 92.

Threads 79*b* on upper adapter 31 and mating threads 85 on valve body 81 retain valve body 81 in an upper closed position, compressing spring 93. Rotating valve body 81 relative to upper adapter 31 releases threads 85 from threads 79*b*, allowing spring 93 to extend and push valve body 81 downward to the open, position of FIG. 6. While in the open position, motor lubricant 37 in motor 13 (FIG. 4) is free to flow downward through flow-by passages 97 into bellows 35. Motor shaft 51 does not move downward with valve body 81, thus lower splined end 57 disengages from receptacle 83 when body 81 moves downward. Bellows 35 is attached and sealed to the lower end of upper adapter 31 below valve 39 by a retainer (not shown).

In one method of operation, the operator will pre-fill bellows 35 of pressure equalizer 17 with motor lubricant 37, as shown in FIG. 2, to a level placing bellows 35 in a desired position. Valve 39 will be closed. The operator supports pressure equalizer 17 axially at the well site, then, lowers and connects motor 13 to pressure equalizer 17. The operator then completely fills motor 13 with motor lubricant 37 while valve 39 remains closed, as shown in FIG. 3. The operator lowers a lower portion of the assembly into the well and attaches thrust bearing unit 15 to motor 13, as shown in FIG. 4. Using a manual tool (not shown), an operator engages upper splined end 71 and rotates thrust bearing unit shah 67 and motor shaft 51. Referring to FIGS. 6 and 7, this rotation causes valve body 81 to unscrew from bore threads 79*b*. Spring 89, gravity, and the weight of motor lubricant 37 in motor 13 push valve body 81 to the lower open position of FIG. 7.

In the open lower position, motor lubricant 37 in motor 13 is free to communicate with bellows 35. The hydrostatic weight of the motor lubricant 37 in motor 13 may cause some of the motor lubricant 37 in motor 13 to flow downward into bellows 35 and cause bellows 35 to extend from the initial position. The amount of motor lubricant 37 flowing downward into bellows 35 leaves an equal volume of space at the upper end of thrust chamber 15 that is free of motor lubricant.

The operator then connects pump 21 to thrust bearing unit 15 and lowers ESP 11 into the well. As ESP 11 is lowered into the well, hydrostatic well fluid pressure acts on bellows 35, causing it to contract. When bellows 35 is contracted back into the initial position, the displaced motor lubricant 37 is pushed back into the free space at the upper portion of thrust chamber 15. An increase in well fluid temperature may cause the motor lubricant 37 to expand. If so, the excess volume of the motor lubricant 37 will flow into bellows 35. Check valves, such as used in the prior art to expel lubricant due to lubricant thermal expansion, may not be needed.

While the disclosure has been shown in only one of its forms, it should be apparent to those skilled in the art that various changes may be made.

The invention claimed is:

1. An electrical submersible pump assembly, comprising:

a pump;

a motor having a rotatable shaft extending along a longitudinal axis and operatively coupled to the pump for driving the pump;

a pressure equalizer coupled to an end of the motor, the equalizer having a movable element for communicating well fluid pressure exterior of the pressure equalizer to motor lubricant in the motor;

an adapter that connects the equalizer to the motor, the adapter having a motor lubricant passage through which motor lubricant in the motor communicates with motor lubricant in the equalizing element;

a valve having an open position and a closed position located in the motor lubricant passage, the open position allowing flow of motor lubricant from the motor to the equalizer and flow of motor lubricant from the equalizer to the motor; wherein:

a first end portion of the shaft is in engagement with the valve while the valve is in the closed position;

a second end portion of the shaft is accessible and manually rotatable prior to operatively coupling the motor to the pump;

the valve is axially movable from the closed position to the open position out of engagement with the shaft in response to manual rotation of the shaft; and wherein the valve further comprises a spring that urges the valve toward the open position.

2. The assembly of claim 1, further comprising a set of internal threads in the motor lubricant passage; and wherein the valve comprises:

a valve element having a cylindrical exterior containing a set of external threads that engage the internal threads while the valve element is in the closed position;

a seal between the exterior of the valve element and the motor lubricant passage adjacent the internal and external threads that seals the valve element in the motor lubricant passage while the valve element is in the closed position;

a drive member on an end of the valve element that engages a drive member on the first end portion of the shaft, the drive members having mating torque drive surfaces; and wherein rotation of the motor shaft in a selected direction rotates the valve element and unscrews the external threads from the internal threads, causing the valve element to move axially from the closed position to the open position with the drive members disengaged from each other.

3. The assembly of claim 1, further comprising a set of internal threads in the motor lubricant passage; and wherein the valve comprises:

a valve element having a cylindrical exterior containing a set of external threads that engage the internal threads while the valve element is in the closed position;

a seal on the exterior of the valve element adjacent the external threads that seals to the motor lubricant passage while the valve element is in the closed position;

the spring being in engagement with the valve element and the adapter to urge the valve element axially from the closed position toward the open position;

a drive member on an end of the valve element that mates with a drive member on the first end portion of the shaft, the drive members having mating torque drive surfaces; and wherein rotation of the motor shaft in a selected direction unscrews the external threads from the internal threads, causing the valve element to move axially from the closed position to the open position with the drive members axially spaced apart from each other.

4. The assembly of claim 1, wherein the valve comprises:

a valve element having a cylindrical exterior;

a seal between the exterior of the valve element and the motor lubricant passage that blocks the motor lubricant passage while the valve element is in the closed position;

a locking feature between the exterior of the valve element and the motor lubricant passage that selectively retains the valve element in the closed position;

the spring being in engagement with the valve element and the adapter to urge the valve element axially from the closed position toward the open position;

a socket on an end of the valve element that receives the first end portion of the motor shaft, the socket and the first end portion of the shaft having mating torque drive surfaces; and wherein rotation of the motor shaft in a selected direction rotates the valve element and releases the locking feature, causing the valve element to move axially from the closed position to the open position and the socket to disengage from the first end portion of the motor shaft.

5. The assembly of claim 1, wherein:

the lubricant passage has a set of internal threads, a seal area joining the internal threads, and a bypass area of larger diameter joining the seal area;

a spring support is mounted in the lubricant passage at a point joining the bypass area, the spring support having a central bore and at least one flow-through passage laterally spaced from the central bore;

the valve comprises an axially movable valve element having a set of external threads that engage the internal threads and a cylindrical exterior that seals to the seal area while the valve element is in the closed position, the cylindrical exterior having a diameter smaller than a diameter of the bypass area, enabling motor lubricant to flow around the valve element and through the flow-through passage while the valve element is in the open position with the external threads released from the internal threads;

a pin protrudes axially from the valve element through the central bore;

the spring surrounds the pin and is located within the central bore, the spring urging the valve element axially toward the open position;

a splined socket is located on an end of the valve element opposite the pin and receives a splined end on the first end portion of the motor shaft while the valve element is in the closed position;

rotation of the motor shaft in a selected direction rotates the valve element and releases the external threads from the internal threads; and the spring causes the valve element to move axially to the open position.

6. An electrical submersible pump assembly, comprising:

a pump;

a motor having a rotatable shaft extending along a longitudinal axis and operatively coupled to the pump for driving the pump, the shaft having a shaft drive member on a lower end;

a pressure equalizer coupled to a lower end of the motor and having a flexible equalizing element that communicates well fluid pressure exterior of the pressure equalizer to motor lubricant in the motor;

an adapter at an upper end of the equalizer that connects the equalizer to the lower end of the motor, the adapter having a motor lubricant passage through which motor lubricant in the motor communicates with motor lubricant in the equalizing element;

a valve element located in the motor lubricant passage, the valve element having an upper position that blocks upward and downward flow of lubricant through the motor lubricant passage and a lower position that allows upward and downward lubricant flow through the motor lubricant passage;

a valve element drive member on an upper end of the valve element that mates with the shaft drive member while the valve element is in the upper position and disengages from the shaft drive member while the valve element is in the lower position;

a locking feature between the valve element and the motor lubricant passage that retains the valve element in the upper position, the locking feature being releasable in response to rotation of the motor shaft in a selected direction; and a spring that biases the valve element in a downward direction.

7. The assembly according to claim 6, wherein:

an upper end of the shaft is accessible and manually rotatable prior to operatively coupling the motor to the pump, enabling the locking feature to be released after the equalizer is coupled to the motor.

8. The assembly according to claim 6, wherein:

the flexible equalizing element comprises a bellows having an open upper end mounted below the valve element and an interior in fluid communication with the motor lubricant passage.

9. The assembly according to claim 6, wherein:

the locking feature comprises a set of internal threads in the motor lubricant passage and a set of external threads on the valve element;

the motor lubricant passage further comprises a seal area joining the internal threads and a bypass area of larger diameter joining and below the seal area;

a spring support is mounted in the lubricant passage at a point below and joining the bypass area, the spring support having a central bore and at least one flow-through passage laterally spaced from the central bore;

the valve element has a cylindrical exterior that seals to the seal area while the valve element is in the upper position, the cylindrical exterior having a diameter smaller than a diameter of the bypass area, enabling lubricant to flow around the valve element and through the flow-through passage while the valve element is in the lower position;

a pin protrudes axially from the valve element through the central bore; and the spring surrounds the pin and is located within the central bore, the spring urging the valve element axially toward the lower position.

10. The assembly according to claim 6, wherein the locking feature comprises external threads on the valve element and internal threads in the motor lubricant passage.

11. The assembly according to claim 6, wherein:

the shaft drive member comprises external splines; and the valve element drive member comprises a socket having internal splines.

12. A method of pumping well fluid from a well with an electrical submersible pump assembly having a pump, a motor with a rotatable shaft extending along a longitudinal axis, and a pressure equalizer with a motor lubricant passage through which motor lubricant in the motor communicates with motor lubricant in the equalizer, the method comprising the following steps:

(a) providing a valve in the motor lubricant passage;

(b) dispensing a selected amount of motor lubricant into the equalizer;

(c) with the valve in a closed position, coupling the equalizer to the motor after step (b) and filling the motor with motor lubricant, the valve while in the closed position blocking flow of motor lubricant from the motor into the equalizer; then (d) shifting the valve to an open position, allowing motor lubricant in the motor to flow into the pressure equalizer and motor lubricant in the equalizer to flow into the motor;

(e) connecting the pump to the assembly and lowering the assembly into the well;

(f) supplying power to the motor to drive the pump; wherein:

step (a) comprises with a spring, urging the valve toward the open position, and with a locking feature, retaining the valve in the closed position;

step (c) comprises engaging an end of the shaft with the valve; and step (d) comprises rotating the shaft a selected amount, which causes the valve to rotate, releasing the locking feature and disengaging the valve from the end of the shaft, then moving axially to the open position.

13. The method according to claim 12, wherein:

step (c) comprises orienting the equalizer and the motor vertically and lowering the motor onto the equalizer.

* * * * *